US006851991B2

(12) United States Patent
Eriksson

(10) Patent No.: US 6,851,991 B2
(45) Date of Patent: Feb. 8, 2005

(54) HULL AND PROPELLER ARRANGEMENT

(75) Inventor: Torbjorn Eriksson, Stockholm (SE)

(73) Assignee: Stormfageln Projekt AB, Stockholm (SE)

( * ) Notice: Subject to any disclaimer, the term of this patent is extended or adjusted under 35 U.S.C. 154(b) by 0 days.

(21) Appl. No.: 10/275,702

(22) PCT Filed: May 9, 2001

(86) PCT No.: PCT/SE01/01010

§ 371 (c)(1),
(2), (4) Date: Dec. 30, 2002

(87) PCT Pub. No.: WO01/85535

PCT Pub. Date: Nov. 15, 2001

(65) Prior Publication Data

US 2003/0157849 A1 Aug. 21, 2003

(30) Foreign Application Priority Data

May 9, 2000 (SE) ..... 0001703

(51) Int. Cl.[7] ..... B63B 5/00
(52) U.S. Cl. ..... 440/66; 440/49; 440/79
(58) Field of Search ..... 440/49, 66, 79

(56) References Cited

U.S. PATENT DOCUMENTS

| | | | | |
|---|---|---|---|---|
| 3,164,118 A | | 1/1965 | Lopez | |
| 3,709,187 A | * | 1/1973 | Marco et al. | 440/50 |
| 3,793,980 A | | 2/1974 | Sherman | |
| 4,371,350 A | | 2/1983 | Kruppa et al. | |
| 4,406,635 A | | 9/1983 | Wiihrer | |
| 4,648,345 A | | 3/1987 | Wham et al. | |
| 4,924,797 A | | 5/1990 | Solia | |
| 5,474,011 A | | 12/1995 | Steinberg | |
| 5,957,078 A | | 9/1999 | Van Tassel | |
| 6,045,420 A | | 4/2000 | Small et al. | |

FOREIGN PATENT DOCUMENTS

WO WO 99/39973 * 8/1999

* cited by examiner

*Primary Examiner*—Sherman Basinger
(74) *Attorney, Agent, or Firm*—Nixon & Vanderhye

(57) ABSTRACT

Hull and propeller arrangement for a surface watercraft (1), provided with at least one propeller (3), in addition to which the propeller (3), at high speeds of the watercraft, is surface-piercing, and the propeller (3) is arranged in such a manner that only the propeller blades (11) or parts thereof are submerged in the water at high speeds of the watercraft (1), in addition to which the hull (2) is provided with at least one streamlined projecting part (4) extends essentially in the longitudinal direction of the hull (2), the projecting part (4), in terms of its outer shape, has, at its aft end (6), an end edge (15) which, at least in part, extends essentially transversely to the longitudinal direction of the projecting part (4), the propeller (3) is locaded immediately astern of the end edge (15), and a part of the propeller, in the radial direction, extends beyond the delimiting surfaces of the projecting part (4). Each projecting part (4) is arranged in such a manner that, at high speeds of the watercraft (1), a bearing area (8) for the watercraft (1) is formed, which consists essentially of a part of the surface of the projecting part (4), which is situated immediately forward of the end edge (15) and on the very bottom of the projecting part (4).

8 Claims, 2 Drawing Sheets

HULL AND PROPELLER ARRANGEMENT

This application is the US national application of international application PCT/SE01/01010 filed 09 May 2001, which designated the US.

TECHNICAL FIELD

The present invention relates to a hull and propeller arrangement.

PRIOR ART

Surface-piercing propellers, that is to say propellers of which the blades, while the boat is underway at high speeds, are situated alternately in a position above the water and in a position below the water while the propeller rotates, are well known for surface watercraft, in particular fast motor boats. Surface-piercing propellers make it possible, for a given hull and a given shaft horsepower, to drive a boat at considerably higher speeds than fully submerged propellers. This improved performance in the case of surface-piercing propellers is due to the fact that the resistance associated with converting the rotational power of the power source into a propelling force for the hull is considerably smaller than in the case of conventional, fully submerged propellers.

In order to reduce the hydrodynamic resistance, it is desirable that as few parts as possible are in the water while the boat is underway. As far as the propulsion arrangement of the boat is concerned, this desire is satisfied to a great extent if parts which do not contribute to the direct power transmission to the water are situated outside the water flow. As far as propellers are concerned, this is achieved if only the propeller blades come into contact with the water and the propeller hub is situated above the surface of the water.

American U.S. Pat. No. 3,793,980 describes a system with surface-piercing propellers by means of which, in a controlled manner, the propeller hub is, at high speeds, situated outside the water flow, and only the propeller blades come into contact with the water.

When a boat planes, the hull acts on the water with a force which presses the water downwards, the hull being supported by the water by means of an opposite force, so that the contact area between the hull and the water is smaller than when the boat travels at displacement speed. At very high speeds, the contact area is relatively very small and is situated furthest astern on the hull. If the hull is designed so as to have a number of contact areas when it planes, at least one of them is situated furthest astern on the hull. If the movement of the boat is subjected to disruption, caused for example by the boat running over a wave on the surface of the water, with a subsequent rotational movement in the pitching direction, the centre of rotation is often located close to the aft contact area between the hull and the water. This movement results in a surface-piercing propeller, which is located at a certain distance in the longitudinal direction from the aft contact area, moving essentially upwards or downwards. This in turn means that, during the movement, the size of that part of the propeller which is situated in the water changes. At times, the propeller can be lifted completely out of the water. The vertical movement of the propeller in relation to the surface of the water leads to disruption of the propulsion of the boat and poor utilization of the propulsion resources of the boat.

When a boat provided with a conventional surface-piercing propeller arrangement travels at relatively low speed just above the speed range for transition between displacement propulsion and planing propulsion, the level of the surface of the water in relation to the hull is raised immediately astern of the hull. This means that a propeller located in this region is surrounded by water at this speed and loses its surface-piercing operating mode. At the displacement speed of the boat, the propeller also loses its surface-piercing operating mode.

In conventional motor boats, the propeller, or each propeller, is located at a certain distance from the drive shaft leadthrough, that is to say the place in which the drive shaft extends from inside the hull to its outside. In order to fix the propeller in the radial direction, the drive arrangement is therefore usually provided, immediately next to the propeller, with a bearing which is fastened to a structure, for example in the form of a bearing bracket, which is in turn fastened to the hull. The drive arrangement thus has to be mounted both at the drive shaft leadthrough and next to the propeller. This conventional arrangement with a bearing for the propeller and associated fastening structures requires the use of a plurality of construction parts and, on contact with the water flow, constitutes a source of resistance during propulsion.

THE OBJECT OF THE INVENTION

One object of the invention is to provide a hull and propeller arrangement for a surface watercraft, which reduces disruption of the propulsion of the boat.

Another object of the invention is to provide a hull and propeller arrangement for a surface watercraft which reduces resistance during propulsion of the boat.

A further object of the invention is to provide a hull and propeller arrangement for a surface watercraft, which affords efficient propulsion in a greater speed range than conventional hull and propeller arrangements.

A further object of the invention is to provide a hull and propeller arrangement for a surface watercraft, which simplifies mounting of the drive arrangement for each propeller.

DESCRIPTION OF THE INVENTION

The position of each propeller immediately astern of an end edge on the aft end of a part projecting from the hull means that the propeller is located close to a surface which, at high speeds, is a bearing surface, which in turn means that rotational movements in the pitching direction of the boat, caused for example by the boat running into waves, will result in only small vertical movements of the propeller. This in turn results in the movements of the propeller blades in relation to the surface of the water being small, and any disruption of the propulsion of the boat is thus small.

The position of each propeller immediately astern of the respective end edge on the aft end of the respective projecting part also means that essentially only the blades of the propeller come into contact with the water flow, even at relatively low speeds when the boat is just above the speed range for transition between displacement mode and planing mode.

According to one embodiment, the propeller is, by virtue of its size and positioning, surface-piercing at displacement speeds, at least at relatively high displacement speeds.

According to the invention, each propeller is provided with a hub which, at the junction between an aft delimiting surface and a peripheral delimiting surface, is designed with a relatively sharp hub edge. This hub edge makes possible effective separation of the water flow from the propeller.

The end edge on each projecting part makes possible effective separation of the water flow from the projecting part.

In the vicinity of the propeller, the projecting part has a cross section which, at least in part, is essentially shaped like a part of a circle, the centre of which in the radial direction essentially coincides with the centre of the propeller. The radius of said circle is essentially the same as the radius of an imaginary circle which, on rotation of the propeller, is generated by the region where the propeller blades meet the propeller hub. The result of this is that, in a controlled manner, the surface of the water flowing past, which has left the projecting part, essentially meets the periphery of the propeller hub.

According to the invention, the leadthrough of the drive shaft through the hull is located immediately next to the propeller hub, which simplifies mounting of the propeller because it eliminates the requirement for the arrangement to have an additional bearing with an associated fastening structure outside the hull.

PREFERRED EMBODIMENT

Figure 1:
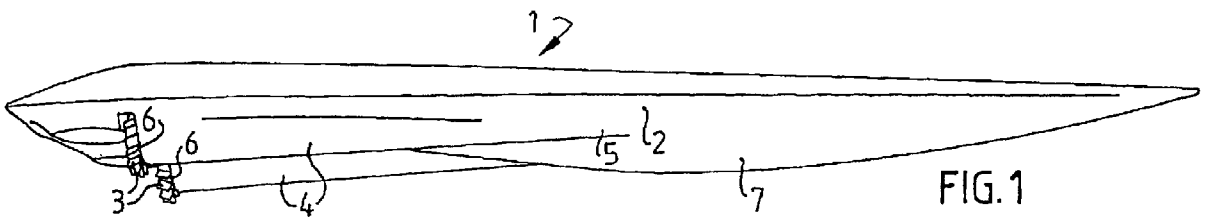
FIG. 1 shows a perspective view from the side and to some extent from below of a motor boat provided with a hull and propeller arrangement according to the invention.

FIG. 1 shows a motor boat 1 with a hull 2 and two propellers 3. The two propellers 3, which are surface-piercing and counter-rotating and the drive shafts of which extend essentially forwards in the longitudinal direction of the boat 1. The hull 2 is provided with two projecting parts 4. Each projecting part 4 is streamlined and extends in the longitudinal direction of the hull 2. Each projecting part 4 has, at a front end 5, a shape which merges in a streamlined manner with the shape of the hull 2. Each front end 5 is, in the longitudinal direction, located approximately in the centre of the hull 2 and, in the transverse direction, between the centre of the hull 2 and its edge. Each projecting part 4 extends to an aft end 6 which is forward of and very close to one of the propellers 3. On its front part, the hull 2 is shaped with a belly 7 where the hull 2 is deeper than in most other places.

Figure 2:
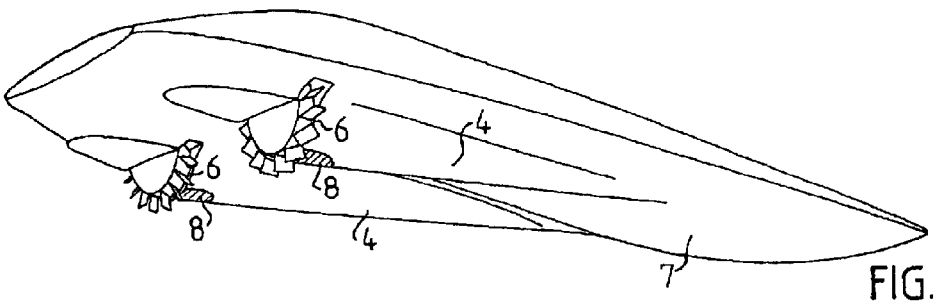
FIG. 2 shows a perspective view obliquely from the stern and to some extent from below of a motor boat provided with a hull and propeller arrangement according to the invention.

Reference is now made to FIG. 2. At high speeds, the boat 1 is supported by the water flowing past on relatively small bearing areas. In this connection, bearing area means an area on the hull 2, which is in direct contact with the water flowing past, and on which forces act, which lift the hull 2 up. At high speeds, two aft bearing areas 8 are formed on the boat 1 in this exemplary embodiment, which are indicated by the lined areas in FIG. 2 and each consist of that part of the surface of each projecting part 4 which extends from the aft end 6 and forward a relatively short distance. A forward bearing area is formed on the belly 7.

Figure 3:
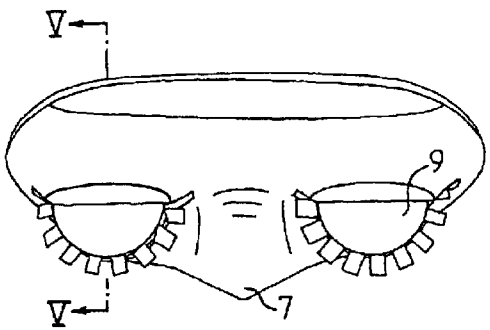
FIG. 3 shows a perspective view from the stern and to some extent from below of a motor boat provided with a hull and propeller arrangement according to the invention.

In FIG. 3, it can be seen that each propeller 3 is designed with a relatively large hub 9 which is in turn designed essentially as a circular plate.

Figure 4:
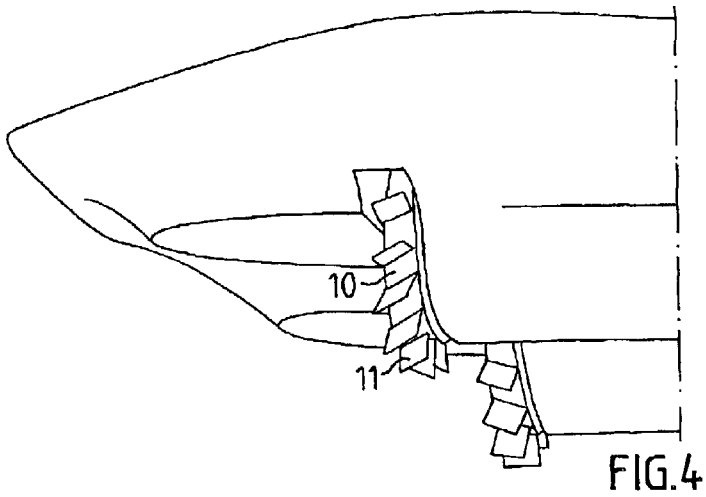
FIG. 4 shows an enlarged view of the aft part of a motor boat shown in FIG. 1.

FIG. 4 shows that the hub 9 has, at its periphery, a peripheral delimiting surface 10 which forms a cylinder, the length of which essentially corresponds to the thickness of the plate which forms the hub 9. A number of propeller blades 11, in this embodiment sixteen, extend in the radial direction from the peripheral delimiting surface 10.

Figure 5:
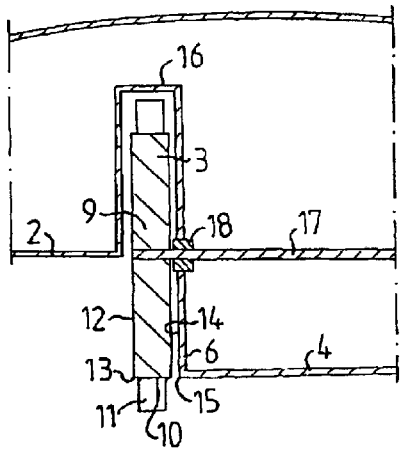
FIG. 5 shows a cross section along the line V—V in FIG. 3 of a hull and propeller arrangement according to the invention.

FIG. 5 shows that the hub 9 has an aft delimiting surface 12 which extends essentially in the radial direction and is orientated essentially at right angles to the peripheral delimiting surface 10. At the junction between the aft delimiting surface 12 and the peripheral delimiting surface 10, a relatively sharp hub edge 13 is formed. This hub edge 13 makes possible effective separation of the water flow from the propeller 3.

The cross section of each projecting part 4 is, at least at the aft end 6, essentially part-circular. Close to the aft end 6, the radius of the cross section corresponds essentially to the outer radius of the hub 9, and the centre of the circle defined by the cross section essentially coincides in the radial direction with the centre of the propeller. At the aft end 6, each projecting part 4 forms an end surface 14 which is essentially parallel to the propeller disc. At the junction between the end surface 14 and the external surface immediately forward of the end surface 14, a relatively sharp end edge 15 is formed. This end edge 15 makes possible effective separation of the water flow from the projecting part 4. The distance between the end edge 15 and the propeller 3 is minimized, taking account of what is practically possible. In any case, it is considerably smaller than the length of each propeller blade 11.

Figure 6:
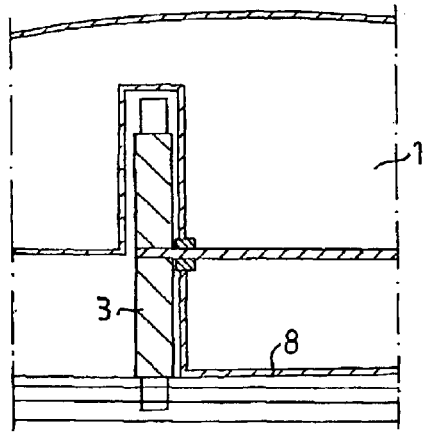
FIG. 6 shows a cross section along the line V—V in FIG. 3 of a hull and propeller arrangement according to the invention.

FIG. 6 illustrates one effect of the propulsion arrangement according to the invention. The water flow is illustrated by lines below the boat 1. As the radius of the cross section of the projecting part 4 close to the aft end 6 essentially corresponds to the outer radius of the hub 9, and the propeller 3 is located immediately astern of the aft end 6, the surface of the water flow lies, at high speeds, in the region where the propeller blades 11 meet the peripheral delimiting surface 10 of the hub 9.

If, at high speeds, pitching movements of the boat 1 occur, caused for example by the boat 1 running into waves, the rotation will take place essentially about a horizontal axis in the transverse direction located in the regions of the aft bearing areas 8. As each propeller 3 is located immediately astern of the respective aft bearing area 8, and thus close to the centre of rotation, said rotational movements will result in only small vertical movements of the propeller 3.

FIG. 5 shows how a part of the propeller 3 is located in a recess 16 in the hull 2. According to the invention, the leadthrough 18 of the drive shaft 17 through the hull 2 is located immediately next to the propeller hub 9, which simplifies mounting of the propeller 3 because it eliminates the requirement for the arrangement to have an additional bearing with an associated fastening structure outside the hull 2.

The positioning of each propeller 3 immediately behind the respective projecting part 4 and its vertical positioning result in the propeller being surface-piercing even at at least relatively high displacement speeds of the boat 1. The fact that each propeller 3 is relatively large also contributes to this.

The motor boat 1 in the embodiment described is provided with two propellers 3 located at a distance from one another in the transverse direction of the hull 2. These are arranged in such a manner that, while the motor boat 1 is underway, the pitch angle of the propeller blades 11 can be adjusted for each propeller 3 individually. As a result, steering of the boat 1 can be carried out without a rudder. The absence of a rudder reduces the number of parts which are in contact with the water while the boat 1 is underway and in this way reduces the resistance during propulsion of the boat 1.

The blades 11 on each propeller 3 are preferably arranged in such a manner that the pitch angle can be adjusted while underway in order to allow it to be adapted to the speed at which the boat is travelling, which in turn means more effective utilization of the propulsion resources of the boat 1.

What is claimed is:

1. A surface watercraft, comprising:

a hull;

two propellers which, at high speeds of the watercraft, are water surface-piercing, said propellers being such that only the propeller blade or parts thereof are submerged in the water at high speeds of the watercraft;

said hull having a belly and two streamlined projecting parts, said projecting parts extending in a longitudinal direction of the hull;

each projecting part in terms of its outer shape, having at its aft end, an end edge which, at least in part, extends generally transversely to the longitudinal direction of the projecting part;

each propeller being located immediately astern of the respective end edge and a part of each propeller, in the radial direction, extending beyond the delimiting surfaces of the respective projecting part; and said projecting parts having arranged at high speeds of the watercraft, an aft bearing area formed on each projecting part, each aft bearing area consisting of a part of the surface of the respective projecting part located immediately forward of said end edge and on the bottom of the projecting part; and a forward bearing area formed on the belly of the hull, whereby the watercraft is supported by the water flowing past the bearing areas on which forces act to lift the hull up.

2. A watercraft according to claim 1 wherein each projecting part has, adjacent the respective propeller, a cross section which, at least in part, is shaped like part of a circle, in that the center of this circle, adjacent the propeller, substantially coincides in a radial direction with the center of the propeller, and wherein the radius of this circle adjacent the propeller is smaller than the radius of the periphery of the propeller.

3. A watercraft according to claim 2 wherein the radius of the circle which is formed by the cross section of the projecting part adjacent the propeller is substantially the same as the radius of an imaginary circle which, on rotation of the propeller, is generated at the juncture of the propeller blades and the propeller hub.

4. A watercraft according to 1 wherein each propeller has, in relation to the propeller blades, a relatively large hub, said hub having at its periphery, a peripheral delimiting surface which is shaped substantially like a cylinder, said hub having an aft delimiting surface, and the junction between the aft delimiting surface and the peripheral delimiting surface having a sharp hub edge.

5. A watercraft according to claim 1 wherein the propellers are located at a distance from one another in the transverse direction of the hull, and arranged in such a manner that, while the watercraft is underway, the pitch angle of the propeller blades can be adjusted individually for each propeller.

6. A watercraft according to claim 1 wherein a leadthrough of a drive shaft through the hull and mounting the propellers is located immediately adjacent the propeller hub.

7. A watercraft according to claim 1 wherein said belly lies generally forwardly of the projecting parts and along a centerline, said aft bearing areas of the projecting parts being located forwardly of the propellers, said propellers being located forwardly of the aft end of the watercraft.

8. A watercraft according to claim 7 wherein said projecting parts include an upwardly extending recess between said parts lying generally along the centerline of the watercraft.

* * * * *